United States Patent [19]

Bindernagel et al.

[11] Patent Number: 4,909,058

[45] Date of Patent: Mar. 20, 1990

[54] METHOD OF CONTROLLED ROD OR WIRE ROLLING OF ALLOY STEEL

[75] Inventors: Ali Bindernagel, Wermelskirchen; Hans Brauer, Leichlingen; Ernst O. Blos, Erkrath, all of Fed. Rep. of Germany

[73] Assignee: Kocks Technik GmbH & Co.

[21] Appl. No.: 196,852

[22] Filed: May 19, 1988

Related U.S. Application Data

[63] Continuation of Ser. No. 110,097, Oct. 14, 1987, abandoned, which is a continuation of Ser. No. 846,592, Mar. 31, 1986, abandoned.

[30] Foreign Application Priority Data

May 25, 1985 [DE] Fed. Rep. of Germany ..... 3518925

[51] Int. Cl.[4] ..... B21B 45/02; B21B 3/02; C21D 8/06

[52] U.S. Cl. ..... 72/201; 72/202; 148/12 B

[58] Field of Search ..... 72/200, 201, 202, 364, 72/365; 148/12 R, 12 B

[56] References Cited

U.S. PATENT DOCUMENTS

| | | | |
|---|---|---|---|
| 370,524 | 9/1887 | Beach | 72/202 |
| 1,029,673 | 6/1912 | Daniels | 72/202 |
| 2,658,741 | 11/1953 | Schmidt et al. | 72/200 X |
| 3,625,043 | 12/1971 | Neumann et al. | 72/202 |
| 3,729,972 | 5/1973 | Kocks | 72/202 X |
| 3,981,752 | 9/1976 | Kranenberg et al. | 148/12 B |
| 4,060,428 | 11/1977 | Wilson et al. | 148/12 B X |
| 4,222,257 | 9/1980 | Theis et al. | 72/201 |

FOREIGN PATENT DOCUMENTS

| | | | |
|---|---|---|---|
| 85039 | 10/1971 | German Democratic Rep. | 72/202 |
| 60-18217 | 1/1985 | Japan | 72/202 |
| 1206168 | 9/1970 | United Kingdom | 72/202 |

*Primary Examiner*—E. Michael Combs
*Attorney, Agent, or Firm*—Toren, McGeady & Associates

[57] ABSTRACT

In a method of controlled rod or wire rolling of alloy steel, for example austenitic steel, in a rolling mill comprising a plurality of roll blocks (1, 2, 3) each having a plurality of roll stands, the temperature of the alloy steel being rolled is brought to a predetermined value in its passage between the blocks (1, 2, 3) by positive cooling by a cooler (6, 7) and/or positive heating by a heater (10, 11). Rolling at a specified temperature, or a specified temperature differential between the surface and the core, of the alloy steel being rolled is thus made possible.

2 Claims, 2 Drawing Sheets

CORE TEMPERATURE
MEAN TEMPERATURE
SURFACE TEMPERATURE 1100
1000
900
°C
1
2
3
4
5

1000
900
800
°C
1
2
3
4
5
6
7
8
9

1000
900
800
°C
1
2
3
4
5
6
7
10
11

1000
900
800
°C
1
4
5
6
7
10
11
12
13
14
15
16
17
18
19

METHOD OF CONTROLLED ROD OR WIRE ROLLING OF ALLOY STEEL

This is a continuation of application Ser. No. 110,097, filed Oct. 14, 1987, abandoned which in turn is a continuation of Ser. No. 846,592, filed Mar. 31, 1986, abandoned.

This invention relates to methods of controlled rolling of alloy steel, for example austenitic steel, to form rods or wire in a rolling mill comprising a plurality of roll blocks. A roll block consists of a group of roll stands arranged closely one after the other.

Alloy steels are usually difficult to roll, depending upon their particular steel composition, and they have a high resistance to deformation and a high susceptibility to cracking. Thus, for example, it is known that the risk of crack formation increases with increasing contents of titanium, chromium and silicon in the steel, whereas nickel, manganese and carbon improve the hot-working capability and thus reduce the risk of crack formation. Since higher contents of chromium, titanium and silicon at temperatures above about 1200° C. lead to the formation of an embrittling alpha phase, the proportion of which in the structure of steel suddenly rises at temperatures above 1250° C., special heating-up techniques are necessary in order to heat such steels to the necessary rolling temperature. Thus, for example, stepped heating up with a fairly long soaking period of, for example, two hours at 1200° C., has proved satisfactory in practice. Heating up to the rolling temperature in this manner is, however, accompanied by high costs merely on account of the long soaking time, because the capacity of the heating furnace decreases with the increase in dwell time.

In addition, however, the temperature sequence of the steel during rolling and particularly the final temperature play an important part with regard to the nature of the surface and mechanical properties of the rolled steel. Thus, for example, a decreasing final temperature in the case of austenitic chrome-nickel steels leads to increasing stabilisation and a raising of the yield strength. This stabilisation is attributable to the fact that static recrystallisation following hot-working is to a greater or lesser extent suppressed. Because of this, in hot-rolling, a continual alternation occurs between stabilisation and recrystallisation and thus a variation occurs in the grain structure depending upon the temperature profile of the hot rolling. This in turn results in a variation in the properties of the rolled steel.

Lower final temperatures require, moreover, longer rolling intervals or reduced throughput speeds and/or lower preliminary annealing temperatures. These in turn, however, result in a reduced plasticity of the rolled material.

A further variable factor which influences the recrystallisation between the individual deformation stages is the change of shape of the steel as it is rolled. Thus, with increasing change of shape, increased recrystallisation and consequently an increase in the yield strength occurs. Longer pauses between the individual deformation stages or lower throughput rates with the objective of achieving a lower final rolling temperature are accompanied, however, by higher costs, and furthermore do not lead to satisfactory results, because the rolled material temperature in this way can be only very inaccurately adjusted. Added to this is the fact that the mechanical properties of the rolled steel are uneven through its cross-section because of the temperature difference between the surface and the core of the rolled steel.

The main object of the present invention is to reduce or overcome the aforementioned difficulties and in particular to provide a method of controlled rolling of alloy steel which permits the temperature of the steel during hot rolling to be adjusted in order to achieve not only a good surface finish of the rolled steel but also a rolled structure, which preferably does not require either heat treatment from the rolling heat or normalising or solution treatment, in order to achieve the intended mechanical properties of the rolled steel, in particular high strength with adequate ductility.

To this end, according to this invention, in a method of controlled rod or wire rolling of alloy steel, for example austenitic steel, in a rolling mill comprising a plurality of roll blocks, through which the steel is passed in succession, the temperature of the alloy steel being rolled is brought to a predetermined value in between adjacent roll blocks by positive cooling and/or positive heating.

The use of roll blocks in this connection has the advantage of causing a lower temperature loss in the rolled steel in relation to the amount of deformation and a relatively high stabilisation due to the rapid sequence of the individual deformation steps. Since these steps are determined, however, once and for all by the characteristic data of the blocks, the positive cooling and/or heating step, which forms part of the invention, following each block, if required in conjunction with an equalisation section, offers the possibility of adjusting the temperature of the rolled steel to provide optimum deformation and recrystallisation conditions. An equalisation section after the heating and/or cooling offers the facility of keeping the temperature difference between the surface of the rolled steel and its core low, in the interests of producing a homogeneous structure of the steel. Since, however, complete equalisation between the surface and core temperatures cannot be achieved in an equalisation section, because the heat loss at the surface is always greater than the quantity of heat flowing out from the core of the rolled steel, forced reheating in the region of the equalisation section offers the possibility of actually equalising the temperature of the surface zone and core zone of the steel. This is preferably done by means of high-frequency heaters, which allow positive heating up of the surface of the rolled steel to be achieved over a short extent in the longitudinal direction of the rolled steel.

On the other hand, however, even with the assistance of positive cooling and/or heating following each deformation step, rolled steel may still be produced, the structure of which in the region near the surface clearly differs from the structure of the core.

The elongation efficiency, which is calculated from the formula $$100 - \frac{A_w}{A_v} \cdot 100,$$

expressed in per cent, where $A_v$ represents the cross-sectional area rolled or pressed away in a rolling pass and $A_w$ represents the cross-sectional area which again appears in the same pass at other positions, preferably is at least 75%, because the temperature of the rolled steel increases with decreasing elongation efficiency. Having regard to the need for the least possible temperature fluctuations of the rolled steel, higher elongation efficiencies are therefore desirable. These can be achieved particularly with three-roll passes.

Independently of the nature of the pass, however, the positive or forced cooling and/or heating in the method of the invention enables the temperature of the rolled steel following each deformation step to be adjusted to a value that is optimum for the next deformation step and the properties of the rolled steel, as a function, for example, of the reduction in cross-section, the speed of rolling, the nature of the particular pass and the analysis of the rolled steel. In particularly, temperature differences through the length of the rolled steel can in this way be equalised.

In the method in accordance with this invention, the steel to be rolled is preferably also adjusted to a predetermined temperature immediately before entering a preliminary block, i.e. in the first deformation step. This leads to a considerable simplication and shortening of the heating necessary in a furnace before rolling and is of advantage particularly when the rolled steel is first descaled with pressurised water before the start of deformation. Such descaling leads to temperature differences between the surface and the core of the steel of several hundred degrees and thus is accompanied by a risk of crack formation. Adjustment of the temperature of the rolled steel before entry to the preliminary block not only eliminates such temperature differences but also simplifies the heating up of the steel to be rolled, because the fine adjustment of the rolled steel temperature in this way takes place immediately at the start of the deformation process.

Thus, the temperature of the steel to be rolled on leaving the heating furnace of, for example, from 1000° to 1200° C. may be reduced to from 800° to 1000° C. before entry to the preliminary roll block, because the forced cooling and/or heating which takes place in the method of the invention during rolling makes it possible to follow closely along the edge of the temperature band that is admissible having regard to the required properties and working capability of the rolled steel. This is accompanied by a considerable saving in energy over the entire rolling operation. Rolling at the lowest possible temperatures is of advantage also because the heat losses during rolling are thereby notably reduced. This can lead to a further reduction in heat losses by from 30 to 40%. The energy saving due to a lower heating temperature before entry to the first roll block and a resultant lower heat loss during rolling, is clearly larger than the additional quantity of energy which may have to be supplied for the forced heating in the method of the invention between the roll blocks and the somewhat higher driving energy of the rolls required due to the greater resistance to deformation of the cooler steel being rolled.

In order to limit the temperature rise in the roll block, an upper limit must be set to the number of roll stands in each roll block, having regard to the resistance to change of shape of the rolled steel, the speed of rolling and the temperature gradient between the surface and core of the rolled steel. The limit is, for example, eight or even only six. The number of roll blocks necessary for a given total number of roll stands does therefore increase, but this is accompanied by the advantage of a reduced temperature rise per block and a reduction of the forced cooling necessary between the blocks.

Examples of methods in accordance with the invention will now be described with reference to the accompanying drawings in which.

Figure 1:
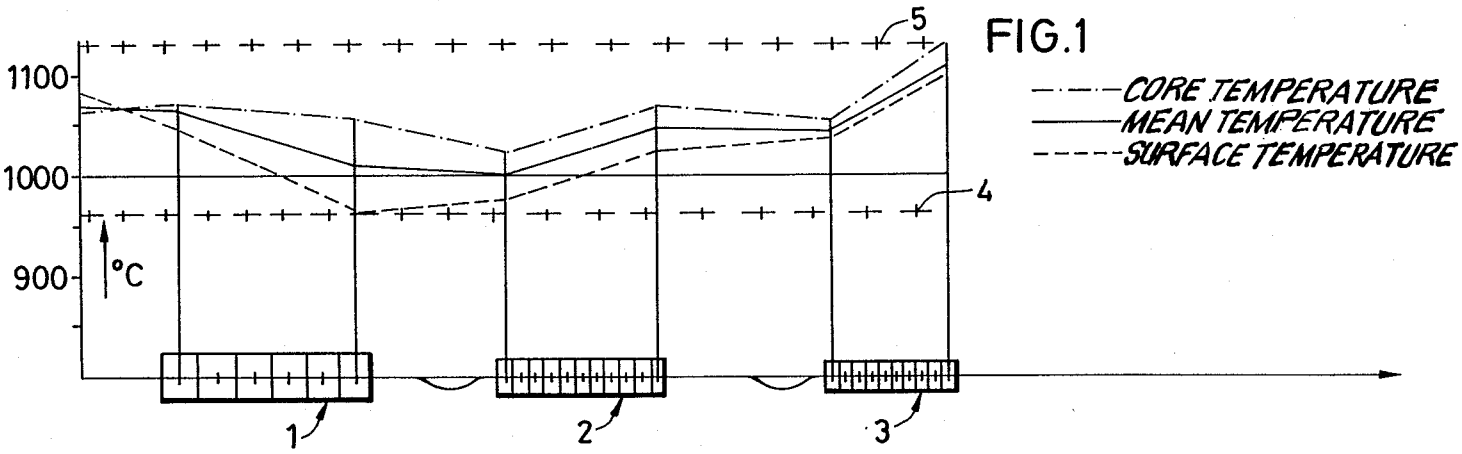
FIG. 1 is a diagram showing temperature changes in the steel being rolled in a conventional rolling mill comprising a plurality of roll blocks without any forced or positive cooling or heating.

The diagram of FIG. 1 relates to a rolling mill comprising a preliminary or roughing roll block 1 having six roll stands, an intermediate block 2 having eleven stands and a finishing block 3 having ten stands. It can be seen how, following the form of the three curves plotted, the core temperature, mean temperature and surface temperature of the rolled steel changes in the absence of positive cooling and positive heating between the blocks 1, 2 and 3. The surface temperature immediately after drawing of the steel to be rolled, that is before any rolling, is initially higher than the core temperature. Even immediately before entry into the preliminary block 1, however, the surface temperature is below the core temperature. In the preliminary block 1, on account of the low rolling speed and water cooling, the core temperature, the mean temperature and particularly the surface temperature, decrease. Following the preliminary block 1, a rise occurs in the surface temperature due to the heat flowing out from the core, accompanied by a reduction in the core temperature. In the intermediate block 2, by contrast, the three characterising temperatures rise as a consequence of the high rolling speed, in spite of water cooling, after which some equalisation of the surface and core temperatures follows, until in the finishing block 3 all three temperatures finally rise drastically. The surface temperature always remains, however, below the core temperature throughout rolling.

With the conventional rolling technique described with reference to FIG. 1, a wide temperature scatter band defined by boundary lines 4, 5 is obtained. The width of this band is determined by the extreme values of the surface and core temperatures, and the lowest surface temperature in the individual blocks can be still lower than that illustrated. Thus, for example, the surface temperature in an individual case, due to direct contact of the surface of the steel being rolled with the water-cooled rolls, can fall as low as about 700° C.

Figure 2:
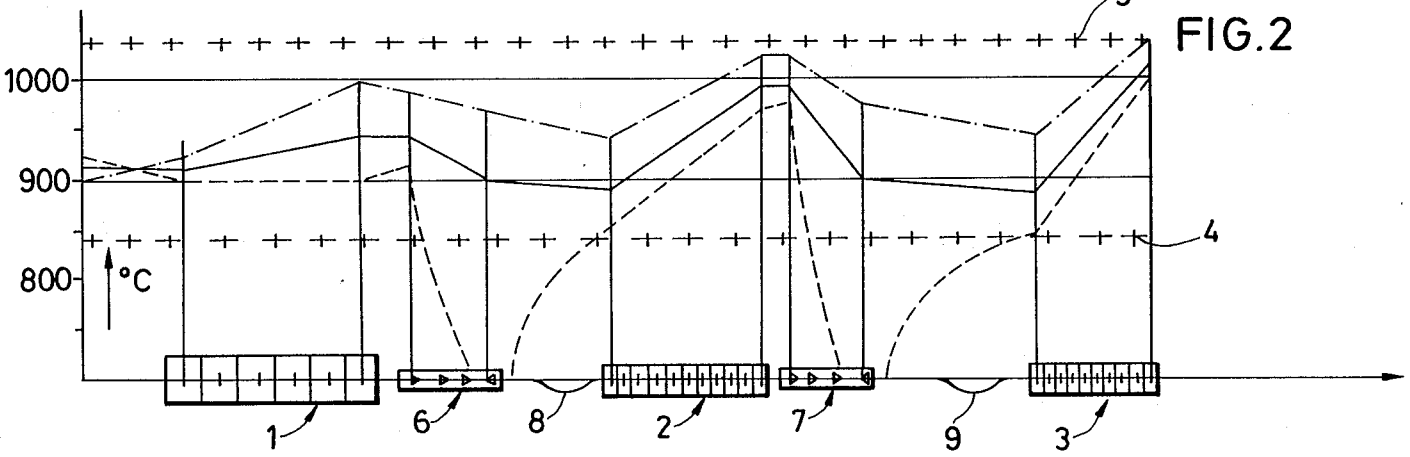
FIG. 2 is a diagram similar to FIG. 1, but showing the temperature changes which occur using the method in accordance with the invention with cooling means in between the roll blocks.

The diagram of FIG. 2 relates to a rolling mill corresponding to that shown in FIG. 1, but in which a cooling section 6, 7 is located between each adjacent pair of blocks and the drawing temperature of the rolled material is lower by about 150° C. than the drawing temperature in the rolling operation according to FIG. 1. From the lower drawing temperature and the resultant higher deformation resistance of the steel being rolled, an increase in the mean temperature of the steel as it is rolled in preliminary block 1 occurs and consequently there is a smaller reduction in the surface temperature, which on leaving the preliminary block is only slightly below the drawing temperature. What is more, as a consequence of the heat flowing out from the core of the material, the surface temperature rises to about the drawing temperature at the inlet into a cooling section 6. In the cooling section 6, the surface temperature is rapidly reduced to a very low value, to approach once again the core temperature in the succeeding temperature equalisation section 8. The surface temperature rise continues in the intermediate block 2, so that the surface and core temperatures on leaving the intermediate block 2 and upon entry of the steel being rolled into the cooling section 7, once again lie close to each other but at a considerably higher level than the drawing temperature.

In the cooling section 7, once again the surface temperature decreases much more than the core temperature, after which in an equalisation section 9 an equalisation of the core and surface temperatures once again follows, and these finally lie relatively close together on leaving the finishing block, against at a high temperature level. The scatter band of the temperature determined by the extreme values in the roll blocks does not differ substantially from that of FIG. 1, in spite of the drastic cooling by quenching of the surface of the steel being rolled in the two cooling sections 6 and 7.

Figure 3:
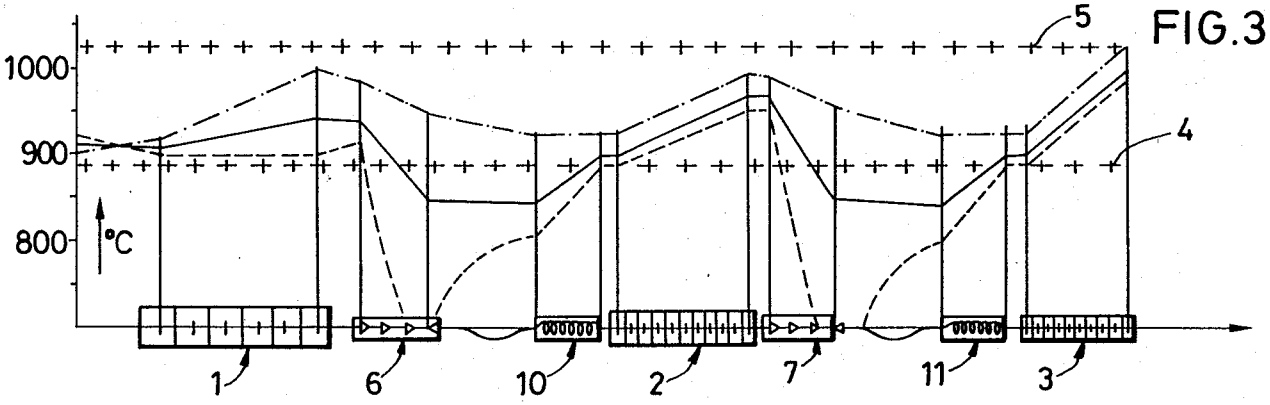
FIG. 3 is a diagram similar to FIG. 2, but showing the temperature changes which take place with both positive cooling and positive heating between the blocks.

A considerably narrower scatter band of the temperatures of the steel being rolled is obtained, by contrast, in the example of FIG. 3, when the intermediate block 2 and the finishing blocks 3 each have a heating section 10, 11 just upstream of them. In this way it becomes possible to cause the surface temperature of the steel on entry into the intermediate block 2 and the finishing block 3 to approach closely to the core temperature. In the two blocks 2 and 3, the rolled steel temperature again rises, but the surface temperature rise of the steel is smaller than the rise in the core temperature as a consequence of the cooling of the rolls.

Figure 4:
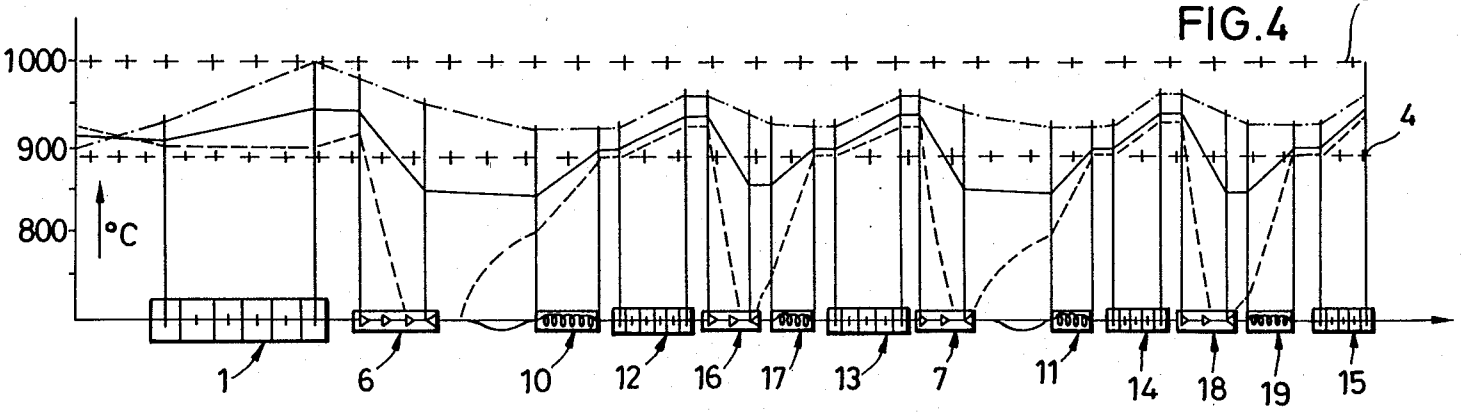
FIG. 4 is a diagram similar to FIG. 3 but illustrative of an example of the method using a rolling mill having a larger number of blocks.

A further narrowing of the temperature scatter band is obtained if the total number of roll stands of all the blocks 1, 2, 3 is distributed over a larger number of blocks, as in the case of the diagram of FIG. 4. Thus, the rolling mill according to FIG. 4 has two intermediate blocks 12 and 13 and two finishing blocks 14 and 15, with a cooling and a heating section 16 and 17 between the two intermediate blocks 12 and 13 and a cooling and a heating section 18 and 19 between the two finishing blocks 14 and 15.

The form of the curves shows how, due to a heating stage at the entry to each block with the exception of the preliminary block 1, a very large equalisation of the deformation temperature can be achieved. Thus, for each deformation step, substantially the same plasticity and the same recrystallisation conditions are obtained. On the other hand, particular deformation conditions can be provided for each block by adjustment of the rolled steel temperature, without the final temperature being thereby influenced. To this extent, in the method in accordance with this invention, the individual blocks are independent from one another in regard to the temperature of the rolled steel. In an individual case, the drawing and final temperatures being assumed unchanged, any temperature pattern may be provided within the scatter band of the conventional, uncontrolled rolling, as a function of the analysis of the steel being rolled and the properties desired of the steel after rolling. The surface and core temperatures can lie close together or be widely different from each other.

In the finishing block 3, as can be seen from the diagram of FIG. 2, even without a heating section at the inlet side, an equalisation of the surface and core temperatures takes place, because lower surface temperatures at entry increase the resistance to deformation and consequently a more pronounced surface temperature rise occurs during finishing rolling, particularly at high rolling speeds. For steel to be rolled having a higher surface temperature, by contrast, the resistance to deformation at the surface of the steel and consequently also the temperature rise in the finishing block is smaller, as can be seen from the form of the curves of FIGS. 3 and 4.

A further equalisation of the temperature curves is obtained if rolling is carried out with blocks having stands with three-roll passes, which by contrast to two-roll pass blocks are distinguished by an especially low difference in temperature of the steel being rolled between entry and exit. The reason for this lies in the fact that two-roll passes having a larger pass spacing and the pass aperture requires a larger pressing area between the roll and steel being rolled. As a consequence of the larger contact area between the steel being rolled and the rolls, higher temperature losses inevitably occur.

Overall, the method in accordance with this invention allows the temperature of the steel being rolled to be adjusted to the optimum for each block taking account of the analysis or composition of the steel. This makes it possible to eliminate temperature differences between the surface and core of the steel being rolled or intentionally to adjust these differences and improve the surface quality of the rolled steel. Thus, for example, the surface of the rolled steel can be quenched to below the recrystallisation temperature, so that the surface zone of the steel can be deformed thermomechanically, i.e. below the recrystallisation temperature, whereas the core of the steel is deformed above the recrystallisation temperature. These relationships can be reversed, if the steel being rolled, after cooling to below the recrystallisation temperature, is correspondingly heated at the surface. In general the method in accordance with the invention permits rolling not only at a substantially uniform temperature throughout the cross-section of the steel being rolled, but also with a specific temperature relationship between its surface and core zones.

Furthermore, by the method in accordance with this invention, the forming of scale during rolling can be largely suppressed, and similarly the deformation resistance can be kept low.

We claim:

1. In a method of controlled rod or wire rolling of alloy steel in a rolling mill, said rolling mill including a plurality of roll blocks, comprising a plurality of said roll blocks and each of said roll blocks comprising a plurality of roll stands, said method including the step of passing said alloy steel through each of said blocks in succession, and the improvement comprising the steps of arranging a preliminary block, at least one intermediate block spaced from the preliminary block and at least one finishing block spaced from said intermediate block, bringing the temperature of the alloy steel being rolled to a predetermined value between said adjacent preliminary block and intermediate block and between said intermediate block and said finishing block by means of positive cooling and then positive heating of said alloy steel being rolled.

2. In a method, as set forth in claim 1, including arranging a first and a second intermediate block between said preliminary block and two said finishing blocks downstream from said second intermediate block and providing the step of positive cooling and positive heating between said first and second intermediate blocks and between said finishing blocks.

* * * * *